United States Patent [19]

Ishimaru

[11] 4,176,901

[45] Dec. 4, 1979

[54] BAKABLE MULTI-PINS VACUUM FEEDTHROUGH

[75] Inventor: Hajime Ishimaru, Ibaraki, Japan

[73] Assignee: National Laboratory for High Energy Physics, Japan

[21] Appl. No.: 911,329

[22] Filed: Jun. 1, 1978

[30] Foreign Application Priority Data

Jun. 5, 1977 [JP] Japan ..... 52/66022

[51] Int. Cl.[2] ..... H01B 17/16; H01B 17/26

[52] U.S. Cl. ..... 339/136 M; 174/152 GM; 339/176 M

[58] Field of Search ..... 339/59 R, 59 M, 61 R, 339/61 M, 94 A, 94 M, 176 M, 136 M, 218 R, 218 M, 126 R, 132 R, 132 B; 174/151, 152 GM

[56] References Cited

U.S. PATENT DOCUMENTS

| | | | |
|---|---|---|---|
| 2,674,645 | 4/1954 | Fine | 339/94 A |
| 2,688,737 | 9/1954 | Oskerka et al. | 339/176 M |
| 2,811,576 | 10/1957 | Hodgdon et al. | 174/151 |
| 2,904,456 | 9/1959 | Nolte | 174/152 GM |
| 3,685,005 | 8/1972 | D'Alessandro | 174/152 GM |
| 3,998,515 | 12/1976 | Panek | 339/94 A |

FOREIGN PATENT DOCUMENTS

| | | | |
|---|---|---|---|
| 446102 | 4/1936 | United Kingdom | 174/151 |
| 589697 | 6/1947 | United Kingdom | 339/218 M |

*Primary Examiner*—Neil Abrams

*Attorney, Agent, or Firm*—Robert E. Burns; Emmanuel J. Lobato; Bruce L. Adams

[57] ABSTRACT

A bakable multi-pins vacuum feedthrough suitable for providing electrical connection from outside into a vacuum vessel of a synchrotron, comprising a metal cylinder and a disc-shaped ceramic pin-holder having multi-pins, wherein the pin-holder is sealingly fixed inside the cylinder at a place axially nonidentical with where the pin-holer and the multi-pins are sealingly fixed, so that favorable resistibility against high vacuum, baking, and strong radioactive rays is attained.

8 Claims, 4 Drawing Figures

BAKABLE MULTI-PINS VACUUM FEEDTHROUGH

DETAILED DESCRIPTION OF THE INVENTION

Figure 1:
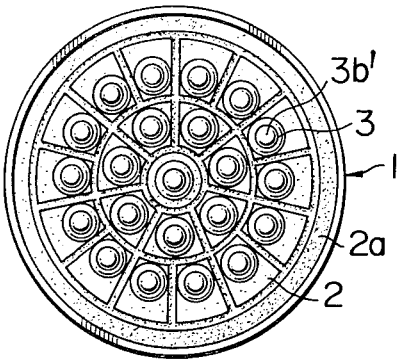

This invention relates to a multi-pins vacuum feedthrough that permits connecting from outside to electric equipment in a vacuum vessel. Particularly it relates to a bakable feedthrough with many terminal pins that is suited for providing electrical connection to a monitor in a proton synchrotron and the like.

Generally, a feedthrough used with a synchrotoron etc. is baked at high temperatures before it is put to use so that it should not impede the maintenance of ultra-high vacuum. For this reason, synthetic resin insulators can not be used therewith.

Therefore, ceramic insulators are used with this type of feedthrough. For instance, many terminal pins may be held compactly in a ceramic pin-holder fitted in a metal cylinder that is to be inset and welded to a hole in the wall of a vacuum vessel. But such ceramic pin-holder is difficult to manufacture, makes wire connecting work difficult, and is liable to break on being baked, thus impairing good airtightness.

This invention intends to solve these difficulties by adding new contrivance to the shape and structure of the metal cylinder and terminal pin. To be more precise, the object of this invention is to provide such bakable vacuum feedthrough which permits manufacture of a ceramic pin-holder carrying many metal terminal pins, has enough strength to withstand baking, and allows electrical connection with ease.

To attain this purpose, a bakable multi-pins vacuum feedthrough according to this invention comprises a metal cylinder having a thin and a thick cylindrical wall portion and an internal step to separate said two cylindrical wall portions, a disc-shaped ceramic pin-holder inserted in said cylinder so as to rest against said step and sealingly fixed to the internal wall of the cylinder, and a plurality of metal terminal pins passed through and sealingly fixed to said pin-holder, formed with a rounded male portion at both ends, and disposed parallel to each other, wherein a sealing weld is formed between a vacuum vessel wall and one end of said thin wall portion which serves as a skirt to absorb welding distortion enough, wherein the male portions at both ends of said pins are indented from the corresponding ends of said cylinder, wherein said pin-holder and internal cylinder wall are sealingly fixed at a place axially not identical, i.e. biased, with a place where said pin-holder and terminal-pins are sealingly fixed, the place being adjacent to one end surface of said pin-holder on the side of said vacuum vessel wall, and wherein in the pin-holder is provided a relief groove adjacent to the atmosphere side of the pin-holder so as to enclose each terminal pin.

The above-described multi-pins vacuum feedthrough of this invention is very easy to manufacture, because the disc-like ceramic pin-holder is inserted so as to rest against the step formed on the internal wall of the metal cylinder and sealingly fixed thereto. In addition, the fact that the pin-holder and internal cylinder wall are sealingly fixed at a place that is axially nonidentical with where the pin-holder and terminal pins are sealingly fixed is conducive to preventing cracking of the pin-holder on baking.

Provision of the rounded male ends to each terminal pin facilitates electrical connection to the vacuum side by use of a connection pin having a female recess to receive the male end. On the atmosphere side, any suitable plug available on the market can achieve connection with a plurality of terminal pins at a time. Where not so high vacuum is required, the same plug may be used for electrical connection on the vacuum side, as well.

Because both ends of the terminal pins are indented from the corresponding ends of the metal cylinder, the multi-pins vacuum feedthrough of this invention can support itself with either of said ends when placed on a table etc., thereby satisfactorily protecting the terminal pins.

Further, welding of this feedthrough inserted into a hole in the vacuum vessel exerts no adverse influence on the ceramic pin-holder, because a sealing weld is formed at one end of the thin cylindrical wall portion and, therefore, welding distortion is thoroughly absorbed by the skirt-like thin cylindrical wall portion.

Figure 3:
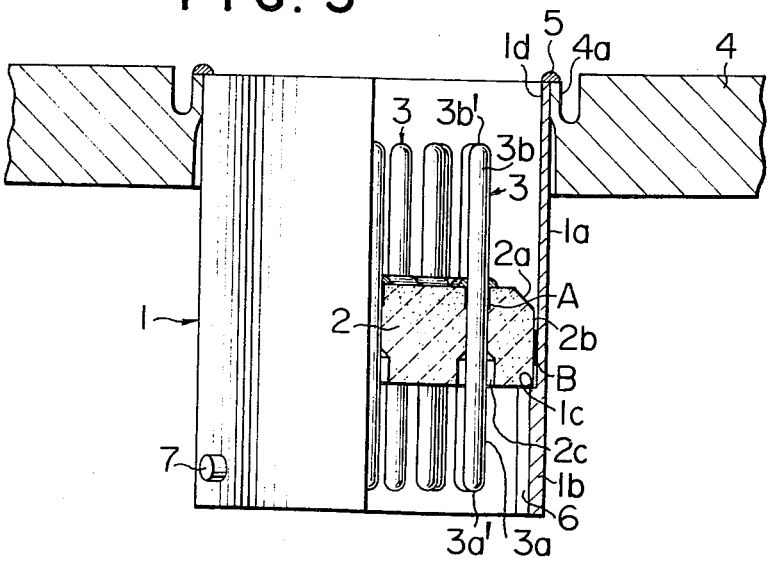
Figure 4:
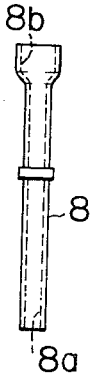
Figure 2:
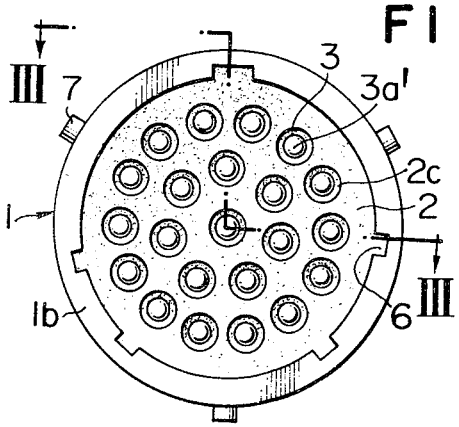

Now a bakable multi-pins vacuum feedthrough that embodies this invention will be described by reference to the accompanying drawings, in which FIG. 1 is an end view seen from one side thereof, FIG. 2 is another end view seen from the other side, FIG. 3 is a side elevation with a partial cross-section taken along the line III—III of FIG. 2, and FIG. 4 is a side elevation of a connection pin into which the terminal pin of the feedthrough fits.

As shown in FIGS. 1 through 3, a cylinder 1 that constitutes the main portion of the feedthrough is made of such alloys as Kovar (trade name) which are composed of iron, nickel, cobalt and the like. It has a thin cylindrical wall portion 1*a* and a thick cylindrical wall portion 1*b*. And a step 1*c*, which separates said two cylindrical portions 1*a* and 1*b*, is formed on the internal wall of the cylinder 1.

A disk-shaped pin-holder 2 made of ceramic (e.g., alumina 98%), serving as an electrical insulator, is inserted in the cylinder 1 so as to rest against the step 1*c*. The whole circumference of this pin-holder 2 is sealingly fixed, at the substantially middle portion of the peripheral surface 2*b* thereof, except the tapered surface 2*a* that faces the vacuum side.

The pin-holder 2 carries a plurality of terminal pins 3 (e.g., twenty-two terminal pins in the embodiment being described) that are passed therethrough parallel to the axis of the cylinder 1 and to each other, spaced regularly from each other, and sealingly fixed thereto. The place A where the terminal pins 3 are sealingly fixed to the pin-holder 2 is axially nonidentical with the place B where the pin-holder 2 is sealingly fixed to the internal wall of the cylinder 1. Also, the place A exists adjacent to one end surface of said pin-holder 2 on the side of the vacuum vessel wall 4.

The individual terminal pins 3 are also made of such alloys as Kovar mentioned previously. The terminal pins 3 and the cylinder 1 are gold-plated to a thickness of approximately 2 μm to prevent the forming of rust during baking.

But the extreme end 1*d* of the skirt-like thin cylindrical wall portion 1*a* is not gold-plated to insure good weldability. A sealing weld 5 is formed between said unplated end 1*d* and the edge 4*a* of a hole made in the vacuum vessel wall 4.

Rounded male portions 3*a*′ and 3*b*′ are formed at the end of one portion 3*a* of the terminal pin 3 that is exposed to the atmosphere and of the other portion 3b that is exposed to the vacuum, respectively. In the pin-holder 2 is provided a relief groove 2c, adjacent to the atmosphere side of the pin-holder 2, for each terminal pin 3 so that especially the atmosphere-exposed portion 3a of the terminal pin 3 has adequate radial flexibility. In addition, the terminal pins 3 are arranged according to an orderly geometrical pattern without any reduction of the whole structural strength. Accordingly, electrical connection can be achieved at a time by use of a plug (not shown) having female ends corresponding to the male ends 3a', which is available on the market. Namely, the terminal pin 3 is relieved of constraint step by step from the fixing place A adjacent to the end surface of the pin-holder 2 on the side of the vacuum vessel wall 4, to the relief groove 2c, through the middle portion where the terminal pin 3 is not sealingly fixed. Accordingly, even though the plug applies an excessive force to the terminal pin 3, the occurrence of cracking in the pin-holder 2 is prevented by the flexibility of the terminal pin 3. Further, another advantage of structural strength when connecting the plug is achieved by that the thick cylindrical wall portion 1b, of high rigidity, of the cylinder 1 is provided at the atmosphere side while the thin cylindrical wall portion 1a of the larger flexibility than said thick cylindrical wall portion 1b is provided at the side of the vacuum vessel wall 4 to which the end 1d of the thin cylindrical wall portion 1a is fixed.

As shown in FIGS. 2 and 3, a plurality of recesses 6 and projections 7 are provided on the internal and external surfaces of the thick cylindrical wall portion 1b so that they will engage with corresponding projections and recesses on the plug, respectively.

Likewise, the vacuum-exposed portion 3b of the terminal pin 3 may be electrically connected by use of a similar plug. Also, a connection pin 8 may be used which has a female engaging hole 8a and a wire fitting hole 8b, in which a wire is inserted and fixed by caulking or soldering, at both ends thereof, as shown in FIG. 4. In this instance, a wire is prefixed to the connection pin 8, and then the engaging hole 8a thereof is put on the male end 3b' of the vacuum-exposed portion 3b of the terminal pin 3. This method permits easier and quicker electrical connection to the cluster of terminal pins 3, compared with the conventional method of soldering a wire to one terminal pin after another.

When this multi-pins vacuum feedthrough is welded to the vacuum vessel wall 4, the skirt-like thin cylindrical wall portion 1a thoroughly absorbs welding distortion and, thereby, protects the fragile ceramic pin-holder 2 that provides electrical insulation between the metal cylinder 1 and the terminal pins 3. On completion of welding, the welded surface is cleaned by glass-bead-blasting thereagainst.

When tested by a helium leak detector, this multi-pins vacuum feedthrough proved to cause leak rate of less than $10^{-10}$ atom.cc.sec$^{-1}$.

Because the places A and B where Kovar and ceramic are sealingly fixed to each other have enough mechanical strength and are axially nonidentical, and because the end 1d of the skirt-like thin cylindrical wall portion 1a is fixed to the vacuum vessel wall 4 by means of the sealing weld 5, this feedthrough can withstand a baking cycle of 300° C.

Both ends 3a' and 3b' of the terminal pins 3 are indented from both ends of the cylinder 1, whereby the ends 3a' and 3b' remain free from shock when the feedthrough alone is placed on a table and the like. Consequently, impairment of airtightness at the places A and B and cracking of the pin-holder 2 can be well prevented.

Made of ceramic, the electrically insulating pin-holder 2 of this feedthrough remains stable and does not deteriorate like a plastic insulator even when irradiated with strong radioactive rays.

As evident from the detailed description given above, a compact cluster of terminal pins is firmly and safely passed through and held by a ceramic pin-holder in the bakable multi-pins vacuum feedthrough according to this invention. This provides favorable resistibility against high vacuum, baking, and strong radioactive rays. Furthermore, it makes electrical connection work and welding to the vacuum vessel wall much easier than ever.

What is claimed is:

1. In combination with a vacuum vessel having a wall with an aperture therein, a bakable multi-pin vacuum feedthrough comprising a metal cylinder having at one end a thin cylindrical wall portion and at the opposite end a thick cylindrical wall portion with an internal shoulder separating said two cylindrical wall portions, a disc-shaped ceramic pin-holder received in said thin cylindrical wall portion and seating on said shoulder, and a plurality of parallel metal terminal pins extending through said pin-holder and projecting from both faces thereof, said pins having at both ends rounded male portions which are recessed inwardly of the respective ends of said metal cylinder, an end portion of said thin cylindrical wall portion being received in said aperture and circumferentially welded to said wall at a location spaced axially inwardly (toward the evacuated interior of said vessel) from said pin-holder, the portion of said metal cylinder in which said pin-holder is received being free of said wall and said thin wall portion of said metal cylinder serving as a flexible skirt to absorb welding distortion so that it does not affect said pin-holder, first sealing means adjacent the inner (vacuum) face of said pin-holder providing a seal between said pin-holder and each of said pins and second sealing means spaced axially outwardly from the inner face of said pin-holder providing a seal between the periphery of said pin-holder and said thin cylindrical wall portion of said metal cylinder, said second sealing means being displaced axially outwardly from said first sealing means, the axially inner portion of said pin-holder in which said first sealing means is provided being free of said thin cylindrical wall portion of said metal cylinder, and said pin-holder having an annular recess surrounding each of said pins and extending inwardly from the outer (atmosphere) face of said pin-holder.

2. A combination according to claim 1, in which said second sealing means is located in approximately a median third of the axial extent of said pin-holder, portions of the periphery of said pin-holder axially inwardly and axially outwardly of said second sealing means being free of said thin cylindrical wall portion of said metal cylinder.

3. A combination according to claim 2, in which said annular recesses in said pin-holder around said pins extend inwardly from the outer (atmosphere) face of said pin-holder approximately to a plane defined by said second sealing means.

4. A combination according to claim 1, in which the inner end of said metal cylinder is approximately flush with the inner face of said wall and in which said aperture is surrounded by an annular recess in the inner face of said wall defining a thin annular dip which embraces the inner end portion of said thin cylindrical wall portion of said metal cylinder and is welded thereto.

5. A combination according to claim 4, in which a portion of the wall of the aperture in said wall axially outward of said weld is free of said thin cylindrical wall portion of said metal cylinder.

6. A combination according to claim 1, in which said thick cylindrical wall portion of said metal cylinder extending axially outwardly from said pin-holder is provided with at least one internal groove extending axially inwardly from the outer end of said metal cylinder.

7. A combination according to claim 6, in which said thick cylindrical wall portion of said metal cylinder axially outwardly of said pin-holder has a plurality of external projections.

8. A combination according to claim 1, further comprising a plurality of elongate tubular connectors each having at one end a socket to receive the inner end portion of one of said terminal pins and means at the opposite end connection of a wire lead.

* * * * *